United States Patent [19]

Kashio

[11] 4,202,362

[45] May 13, 1980

[54] COIN-DELIVERING DEVICE

[75] Inventor: Toshio Kashio, Tokyo, Japan

[73] Assignee: Casio Computer Co., Ltd., Tokyo, Japan

[21] Appl. No.: 936,028

[22] Filed: Aug. 23, 1978

[30] Foreign Application Priority Data

Aug. 26, 1977 [JP] Japan ..... 52-102396

[51] Int. Cl.[2] ..... G07D 1/00

[52] U.S. Cl. ..... 133/4 A; 133/1 R

[58] Field of Search ..... 133/4 R, 4 A, 5 R, 5 A, 133/5 B, 1 R; 221/123, 133, 258, 277, 262; 414/112, 125, 129

[56] References Cited

U.S. PATENT DOCUMENTS

| | | | |
|---|---|---|---|
| 2,691,379 | 10/1954 | Foushee | 133/5 R |
| 2,848,003 | 8/1958 | Gross | 133/2 |
| 3,785,524 | 1/1974 | Smith | 221/123 X |
| 3,819,087 | 6/1974 | Schuller et al. | 221/253 X |
| 3,972,338 | 8/1976 | Schmitt | 133/4 A |

FOREIGN PATENT DOCUMENTS

| | | | |
|---|---|---|---|
| 1445089 | 8/1976 | United Kingdom | 133/4 A |

*Primary Examiner*—Robert J. Spar
*Assistant Examiner*—Edward M. Wacyra
*Attorney, Agent, or Firm*—Frishauf, Holtz, Goodman & Woodward

[57] ABSTRACT

A coin-delivering device which comprises a plurality of coin holders equiangularly arranged in a circumferential direction respectively to hold coins of different denominations and a plurality of coin receptacles similarly equiangularly arranged in a circumferential direction set below the coin outlets of the respective coin holder at a prescribed spacing, and wherein a coin placed on the coin receptacle is flipped out by an arm rotated by a rotary shaft, and the coin is or is not delivered as a function of the coin-flipping arm being selectively moved upward or downward by a control signal.

9 Claims, 12 Drawing Figures

COIN-DELIVERING DEVICE

BACKGROUND OF THE INVENTION

This invention relates to a coin-delivering device and with, for example, a cash register automatically to take out change coins in accordance with the result of calculation.

In recent years, some cash registers have been provided with a change coin-delivering device for automatically taking out coins. Such a change coin-delivering device comprises a plurality of hollow cylindrical coin holders equiangularly arranged in a circumferential direction on a support board at a prescribed space to hold coins of different demominations such as 25 cents, 10 cents, 5 cents and 1 cent and a plurality of the corresponding solenoids set near the bottoms of the respective coin holders. Where the solenoid is energized, a coin taking the lowermost position in the coin holder is flipped out through a gap provided between the coin holder and support board. Where, with such arrangement, solenoids corresponding to the required denominations of coins are repeatedly actuated in accordance with a calculated amount of change, then desired change coins are selectively drawn out.

With the prior art coin-delivering device, a solenoid is provided for each coin holder, thus requiring a large number of solenoids and consequently making it impossible to manufacture a coin-delivering apparatus at low cost.

This invention has been accomplished in view of the above-mentioned circumstances, and is intended to provide a coin-delivering device capable of reliably delivering required coins by a simple arrangement without the necessity of providing a solenoid for each coin holder.

SUMMARY OF THE INVENTION

For the above-mentioned object, this invention provides a coin-delivering device, which comprises a plurality of coin holders equiangularly arranged in a circumferential direction; a plurality of coin receptacles arranged similarly equiangularly in a circumferential direction below the coin outlets of the respective coin holders at a prescribed space; an arm mounted on a rotary shaft to flip out a coin placed on the coin receptacle when the rotary shaft is turned; drive means for moving the arm upward or downward along the rotary shaft as need arises, wherein said drive means is selectively operated in accordance with the rotation angle of the arm. With the above-mentioned arrangement, the vertical movement of the rotatable arm is controlled by a solenoid, thereby enabling a coin of a specified denomination to be delivered in the operation timing of the rotatable arm. Therefore, the coin-delivering device of this invention has such simple arrangement as eliminates the necessity of providing a solenoid for each coin holder and enables a coin of any desired denomination to be drawn out by means of a single solenoid. With the present coin-delivering device, it is only necessary to keep the arm rotated all the time. Therefore, the arm need not be repeatedly controlled for start and stop, but can quickly take out a coin of any required unit. Further advantage of the invention is that application of a single solenoid reduces the cost of a coin-delivering device.

DETAILED DESCRIPTION

Figure 1:
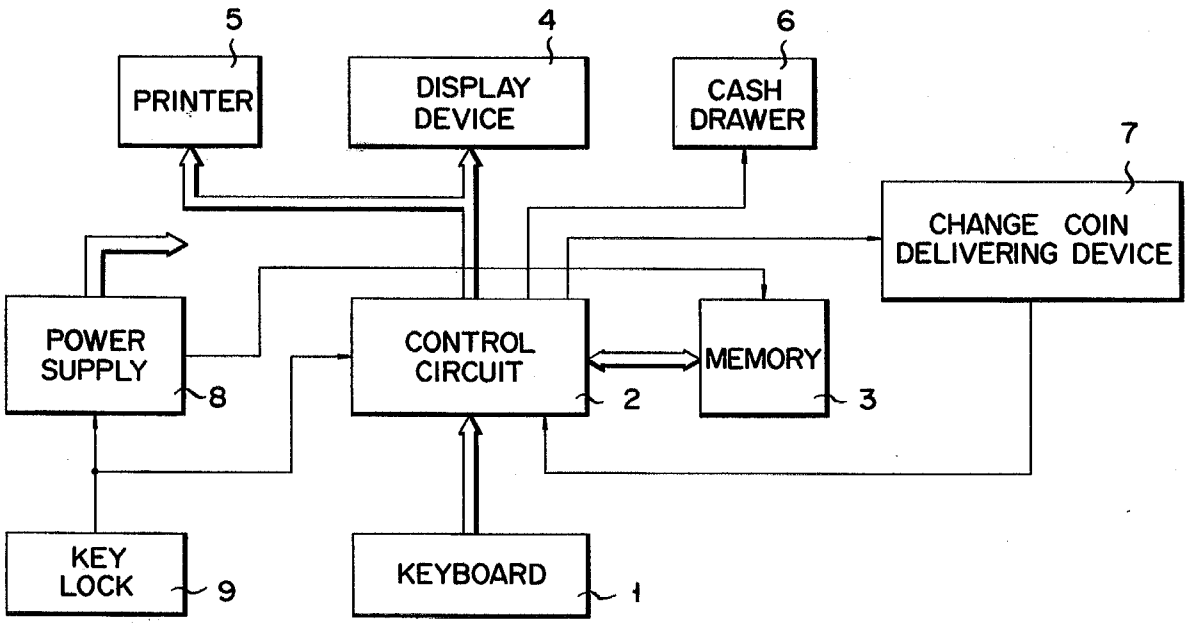
FIG. 1 is a block circuit diagram of an entire cash register.

There will now be described by reference to the accompanying drawing a coin-delivering device embodying this invention, referring to FIG. 1, referential numeral 1 denotes a keyboard. Data supplied by operation of the keys of the keyboard 1 is conducted to a control circuit 2 which is connected to a memory 3 for storing, for example, preset data, and data on sales. Input data supplied from the keyboard 1 is calculated in the control circuit 2. The results of said calculation are stored for the memory 3. Input data delivered from the keyboard 1 and the results of calculation carried out in the control circuit 2 are sent forth to a display device 4 for indication and also to a printer 5 to be impressed on a slip. An output signal from the control circuit 2 controls the operation of a cash drawer 6 for holding sales money and a coin-delivering device 7. Referential numeral 8 denotes a power source which supplies power for operation of the above-mentioned sections of the cash register. A key lock section 9 determines whether or not the power source 8 and control circuit 2 should be operated. Namely, while a key on the keyboard 1 is not depressed, the key lock 9 renders the power source 8 and control section 2 in operative. Conversely where a required key is depressed, the key lock 9 is released to operate the power source 8, which in turn supplies power to the various sections of the cash register. At this time, the control circuit 2 is also put into operation upon receipt of input data from the keyboard 1. Even under the key locked condition, the memory 3 is still supplied with power to hold data already stored therein.

There will now be described by reference to FIGS. 2 and 3 the arrangement of the coin-delivering device 7 embodying this invention. Referential numerals 11, 12 denote support boards vertically spaced from each other. A motor 13 is set at the center of the surface of the upper support board 11. The lower end of a vertically set rotary shaft 14 of the motor 13 extends to the surface of the lower support board 12 through the upper support board 11. On the upper support board 11 a plurality of cylindrical coin holders 15*a* to 15*e* are equiangularly placed in a circumferential direction around the motor 13. These coin holders 15*a* to 15*e* hold coins of different denominations such as 1 cent, 5 cents, 10 cents, 25 cents. Each of the coin holders 15*a* to 15*e* penetrates the upper support board 11 with the lower end of the coin holder spaced from the surface of the lower support board 12 at a slightly larger distance than the thickness of one coin. The central section of the lower support board 12 is cut out except for the portions facing the bottoms of the coin holders 15*a* to 15*e*. Namely, the remaining portion facing said coin holder bottoms protrude into the cutout space 16 to form coin receptacles 17*a* to 17*e*. The rotary shaft 14 of the motor 13 is positioned at the center of the cutout space 16. A plurality of vertically extending guide grooves 18 are equiangularly cut out in the peripheral surface of the lower end portion of the rotary shaft 14. A guide member 19 vertically slidable through the guide grooves 18 is fitted to the lower end of the rotary shaft 14. Provided below the guide member 19 is a stopper 20 (FIG. 3) to prevent the fall of the guide member 19. An annular groove 19*a* is cut out in the peripheral surface of the guide member 19. The bottom of the guide member 19 is fitted with a horizontally extending arm 21. The arm 21 is rotated by the motor 13 to pass through a gap allowed between the coin holders 15*a* to 15*e* and the coin receptacles 17*a* to 17*e*, thereby flipping out a coin placed on any of said coin receptacles 17*a* to 17*e*. Normally, however, the arm 21 is positioned below the coin receptacles 17*a* to 17*e*. A solenoid 22 is set below the upper support board 11. Disposed below the solenoid 22 is a plunger 23, whose lower end is fitted with another arm 24. The forward end of this arm 24 is formed into a substantially rounded U-shape for engagement with the annular groove 19*a* of the guide member 19. A coil spring 25 is fitted to the plunger 23 normally to urge the arm 24 downward. Where the solenoid 22 is energized, the plunger 23 is pulled into the solenoid 22 against the force of the coil spring 25, causing the arm 24 to be moved upward with the plunger 23 for a prescribed distance. The upward movement of the arm 24 leads to the rise of the guide member 19 and the shift of the coin-flipping arm 21 above the coin receptacles 17*a* to 17*e* ready for the delivery of a coin. Provided below the lower support board 12 is a discharged coin guide member 26 (FIG. 3) for conducting the taken-out coin to the outside of the coin-delivering device. The upper portion of the rotary shaft 14 of the motor 13 is fitted with a start pulse-generating ring 27 and a timing pulse-generating ring 28. The start pulse-generating ring 27 is provided with one projection, and the timing pulse-generating ring 28 comprises, for example, five projections in conforming to a number of coin holders used 15*a* to 15*e*. Disposed adjacent to the start-pulse-generating ring 27 and timing pulse-generating ring 28 are the corresponding detectors 29, 30 for detecting the projections of said rings 27, 28 by means of, for example, an optical process. In this case, the issue of timing pulses $P_1$ to $P_5$ by the ring 28 and the detection of said issue by the detector 30 are designed to take place when the coin-flipping arm 21 is brought to the substantially central part of the respective coin receptacles 17*a* to 17*e* as shown in FIG. 4. The generation of a start pulse I by the ring 27 and the detection of said generation by the detector 29 are designed to be carried out a little before a referential pulse 1 included in the timing pulses is generated. Output detection signals from the detectors 29, 30 are conducted to the control circuit 2 of FIG. 1.

Figure 5:
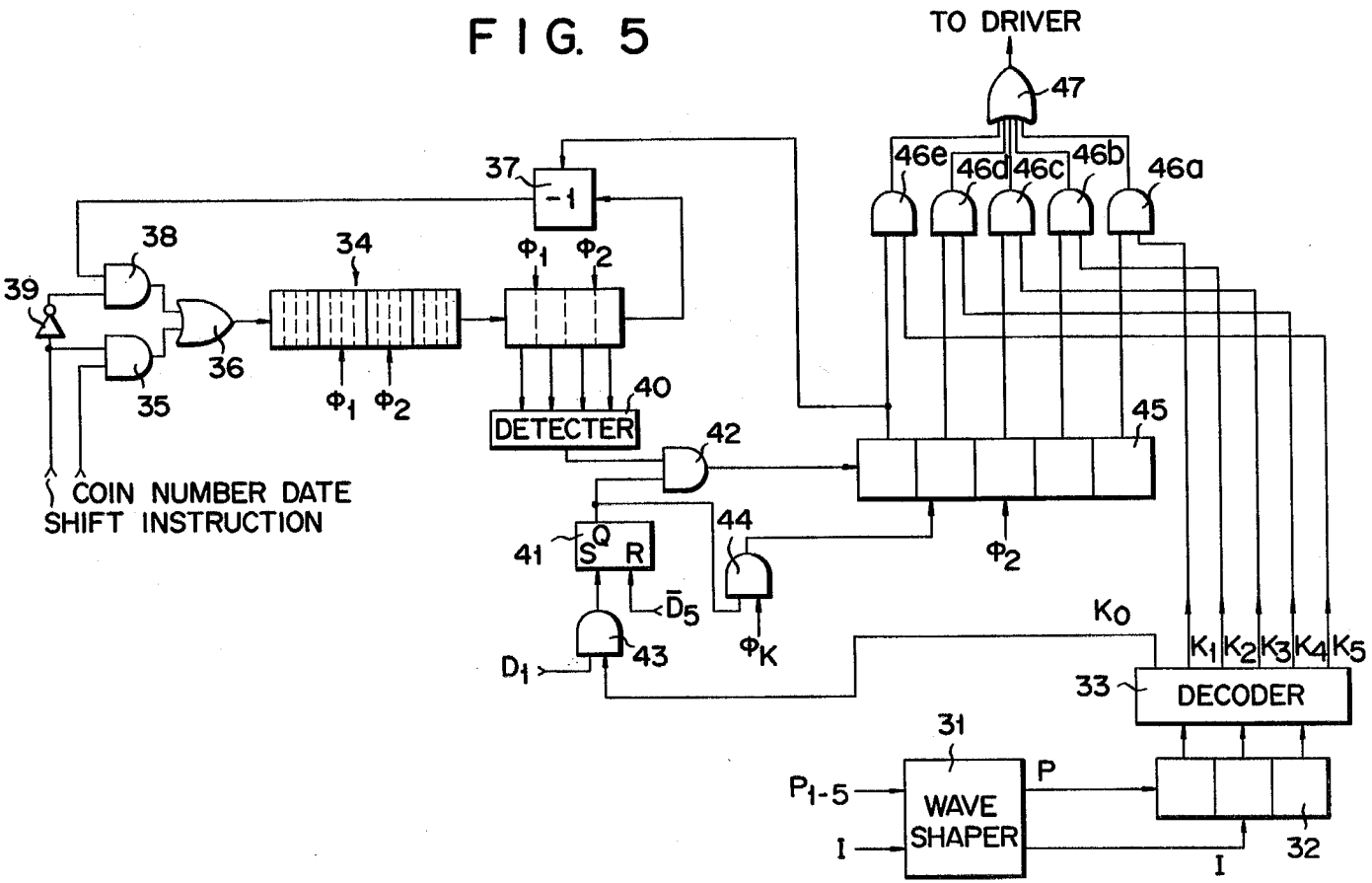
FIG. 5 shows the detailed arrangement of a coin delivery control section of a control circuit included in FIG. 1.
Figure 6:
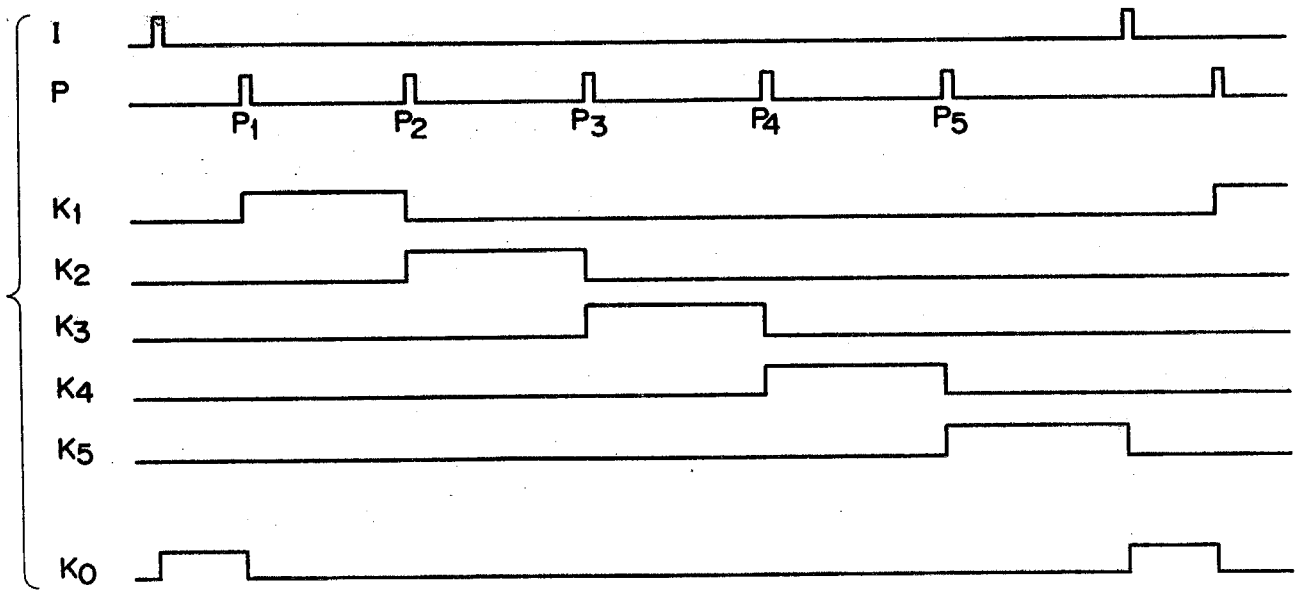
FIGS. 6 and 7 are timing charts indicating the points of time at which the respective timing signals are issued.
Figure 7:
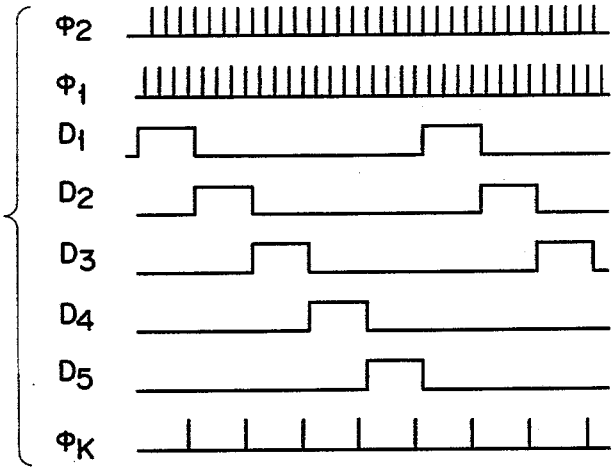

FIG. 5 shows the arrangement of that section of the control circuit 2 which controls the delivery of change coins. Referential numeral 31 of FIG. 5 is a wave shaper for shaping the waveforms of timing pulse $P_1$ to $P_5$ delivered from the detector 30 and a start pulse I obtained from the detector 29. Output wave-shaped timing pulses $P_1$ to $P_5$ from the wave shaper 31 are supplied as count-up signals to a binary counter 32 of, for example, a 3-bit 6-scale type (designed to count from 0 to 5 of decimal numerals). An output start pulse I is sent forth as a reset signal to the binary counter 32. Accordingly, output signals from the binary counter 32 are issued as timing signals $K_0$ to $K_5$ through a decoder 33. FIG. 6 is a timing chart of the start pulse I, timing pulses $P_1$ to $P_5$ and timing signals $K_0$ to $K_5$. Referential numeral 34 of FIG. 5 denotes a register of for example, a 5-digit type in which there is stored a number of coins of the respective denominations which are going to be delivered. Each digit is termed of 4 bits, and written in synchronization with clock pulses $\phi_1$ and read out in synchronization with clock pulses $\phi_2$. The register 34 is supplied through an AND circuit 35 and an OR circuit 36 with data on a number of change coins being delivered according to the result of calculation and also a timing signal issued per word to act as a shift instruction. The first to the fifth digit positions are respectively supplied with a number of change coins of five denominations which are going to be delivered such as 1 cent, 5 cents, 10 cents, 25 cents, zero. Outputs from the five digit position of the register 34 are successively issued by shift to a $-1$ subtraction circuit 37 where the outputs are subtracted by one each time. The subtracted output signals are later conducted to an AND circuit 38. This AND circuit 38 is already supplied with the above-mentioned shift instruction through an inverter 39. An output signal from the AND circuit 38 is sent forth to the register 34 through the OR circuit 36. The respective bit outputs from the first digit position of the register 34 are drawn out through a detector 40 for detecting data present in any of the respective digit positions and then conducted to an AND circuit 42 together with an output signal from a flip-flop circuit 41. The set terminal S of the flip-flop circuit 41 is supplied through an AND circuit 43 with a digit signal D1 for specifying the first digit position of the register 34 and a timing signal $K_0$ delivered from the decoder 33. The flip-flop circuit 41 has its reset terminal R supplied with a signal $\overline{D5}$ reversed from a digit signal D5 and is reset by the trailing edge of the $\overline{D5}$ signal. An output signal from the flip-flop circuit 41 is conducted to an AND circuit 44 together with a clock pulse $\phi_k$ issued in the last per word timing. An output pulse from the AND circuit 44 is supplied as a write-read pulse to a 5-bit output buffer register 45 for delivery of coins, together with a clock pulse $\phi_2$. An output signal from the flip-flop circuit 41 is also sent for the from the AND circuit 42. An output signal from the AND circuit 42 is written in the buffer register 45 in synchronization with an output signal from the AND circuit 44. Data stored in the buffer register 45 is read out in synchronization with the clock pulse $\phi_2$. The respective bit outputs from the buffer register 45 are supplied to the AND circuits 46*a* to 46*e*. An output signal from the first digit position of the buffer register 45 is carried to the $-1$ subtraction circuit 37 as an instruction for $-1$ subtraction. The AND circuits 46*a* to 46*e* are supplied with output timing signals $K_1$ to $K_5$ from the decoder 33. Output signals from the AND circuits 46*a* to 46*e* are delivered to a driver (not shown) of the solenoid 22 of FIG. 2.

Figure 8:
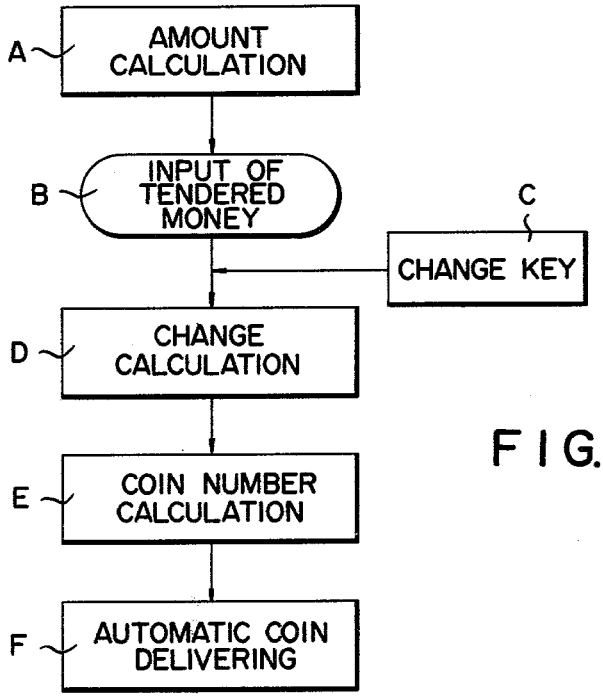
FIG. 8 is a flow chart illustrating the operation of an entire cash register.

There will now be described a cash register using a coin-delivering device of this invention arranged as described above. When sales amounts are supplied to a cash register by operation of the keyboard 1, said sales amounts are arithmetically processed in the control circuit 2. Namely, calculation of sales amounts is carried out the step A of FIG. 8. The contents of the sales amounts processed in the control circuit 2 are visibly indicated on the display section 4 of FIG. 1, and are also impressed on a slip by the printer 5. After calculation of sales amounts in the step A, an amount of money tendered by a customer is supplied to the cash register. In the step D, an amount of a change payable back to the customer is calculated after operation of a change key in the step C. In the step E, calculation is made of a number of coins of the respective denominations which constitute the change thus counted. The control circuit 2 supplies a control signal to the coin-delivering device 7 in accordance with the result of calculating a number of change coins of the required denominations. In the step F of FIG. 8, change coins are automatically delivered.

Figure 9:
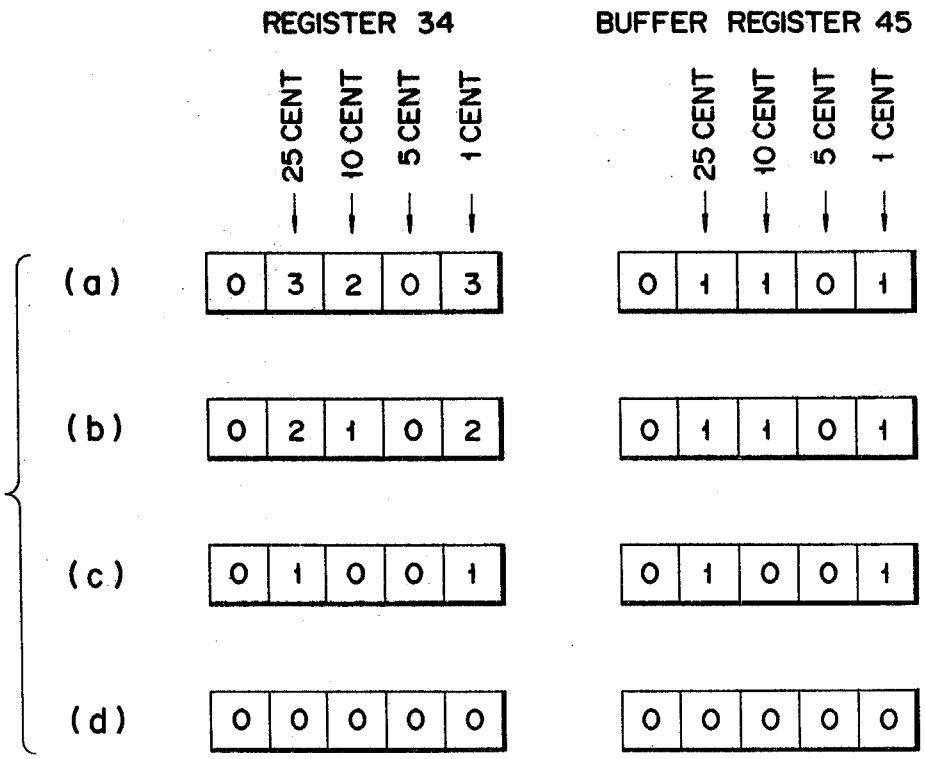
FIG. 9 shows the contents of a cash register which vary with the withdrawal of change coins.

There will now be described the automatic coin delivery of the present coin-delivering device 7. Now let it be assumed that a change has been figured out to be, for example, 24.98 dollars and that portion of 0.98 dollar, namely, 98 cents which is divisible by a unit of 25 cents is paid in three ¢25-coins, and the remainder of the 98 cents, namely, 23 cents are paid in a suitable number of coins having smaller denominations than the ¢25-unit. Then the five digit positions of the register 34 of FIG. 5 are supplied with data denoting a number of coins of the respective denominations which are to be delivered as shown in FIG. 9 (a). Namely, the five digit positions of the register 34 of FIG. 5 are supplied with data denoting a number of coins of the respective denominations having a total amount of 98 cents, that is, 3 25¢-coins, 2 10¢-coins, 0 5¢-coin and 3 1¢-coins. Where a timing signal $K_0$ is issued from the decoder 33, then the AND circuit 43 generates an output signal in synchronization with the digit signal D1 to set the flip-flop circuit 41, which in turn produces a signal having a logic level of "1", thereby opening the gate of the AND circuit 42. Data denoting 1 cent which is stored in the first digit position of the register 34 is sent forth through the detector 40 and AND circuit 42 to the output buffer register 45. If, in this case, any bit included in the first digit position of the register 34 indicates a logic level of "1", then the detector 40 issues an output having a logic level of "1". This "1" signal passes through the AND circuit 42 when the output of the flip-flop circuit 41 is issued and is written in the output buffer register 45 in synchronization with a clock pulse $\phi_k$ of the AND circuit 44. An output signal from the first digit position of the output buffer register 45 is carried to the −1 subtraction circuit 37. The output of said output buffer register 45 is read out in synchronization with a clock pulse $\phi_2$. Upon receipt of a signal having a logic level of "1" from the first digit position of the output buffer register 45, the −1 subtraction circuit 37 is put into operation, thereby subtracting by one the data sent forth from the first digit position of the register 34 which denotes 1 cent. A signal indicating the result of said substraction is again supplied to the register 34 through the AND circuit 38 and OR circuit 36. Thereafter, data denoting a number of coins of the respective denomination which are stored in the register 34 are successively shifted to the first digit position of the register 34. If, in this case any bit included in the data indicates a logic level of "1", then said data is transferred to the output buffer register 45. Data denoting a number of coins of the respective denomination which are issued from the register 34 are subtracted by one in the −1 subtraction circuit 37 and then again supplied to the register 34. Where data denoting a number of coins of the respective denominations indicates a number of [1] or over, then a signal having a logic level of "1" is successively written in the corresponding digit positions of the output buffer register 45. Where the register 34 is supplied with data denoting a number of coins of the respective denominations, that is, [03203] then the output buffer register 45 is supplied with data [01101] as illustrated in FIG. 9(*a*). Where the output buffer register 45 is supplied with all data denoting a number of coins of the respective denominations, then the flip-flop circuit 41 is reset by the edge of a digit signal $\overline{D5}$ (the trailing edge of a digit signal D5), thereby closing the gate of the AND circuit 42. Where every bit included in the respective digit positions of the output buffer register 45 has a logic level of "1", then timing signals $K_1$ to $K_5$ previously supplied from the decoder 33 are successively issued from the corresponding AND circuits 46*a* to 46*e*. Upon receipt of the timing signals $K_1$ to $K_5$, output signals from the OR circuit 47 are all made to have an output. The solenoid 22 of FIGS. 2 and 3 included in the coin-delivering device 7 is put into operation during the period of the timing signals $K_1$ to $K_5$. The motor 13 of the coin-delivering device 7 is always driven, causing the coin-flipping arm 21 to be rotated all the time below the coin receptacles 17*a* to 17*e*. Where a change coin is to be delivered, the solenoid 22 is energized in the cut-out space 16 just before the coin-flipping arm 21 reaches the required coin receptacle, thereby raising the coin-flipping arm 21 to a prescribed height. As the result, said arm 21 is pressed due to its relation against a coin taking the lowermost position in the specified one of the coin holders 17*a* to 17*e* at a coin outlet disposed at the bottom of said specified coin holder, thereby flipping out a coin of the prescribed denomination, if necessary, in succession. Since, at this time, the solenoid 22 is energized during the period of the timing signals $K_1$ to $K_5$, the coin-flipping arm 21 is kept raised while being rotated, thereby delivering one coin after another of the respective denominations, that is 1 cent, 5 cents, 10 cents and 25 cents.

Where the coin-flipping arm 21 delivers a coin by making a first full rotation, then data initially set in the five digit positions of the register 34 which denote a number of coins of the respective denominations being delivered are all subtracted by one and shows a pattern as illustrated in FIG. 9(*b*), that is [02102]. When the coil-flipping arm 21 makes a second full rotation, and the decoder 33 issues a timing signal $K_0$, then the AND circuit 43 produces an output signal in synchronization with the digit signal $D_1$, thereby setting the flip-flop circuit 41. As described above, the output buffer register 45 is supplied with a signal having a logic level of "1" or "0" in accordance with the contents of the register 34.

At this time, as shown in FIG. 9(*b*), data denoting a number of coins of the 1¢, 10¢ and 25¢ denominations indicate a larger number than [1]. Therefore, the first, third and fourth digit positions of the output buffer register 45 are supplied with a digit [1] and the second and fifth positions thereof are supplied with a digit [0]. Accordingly, the gates of the AND circuits 46*a*, 46*c*, 46*d* are opened. Timing signals $K_1$, $K_3$, $K_4$ are issued through said AND circuits 46*a*, 46*c*, 46*d*, and OR circuit 47. The solenoid 22 is energized during the period, of the timing signals $K_1$, $K_3$, $K_4$. As the result, the coin-flipping arm 21 is lifted just in front of the coin holders 15*a*, 15*c*, 15*d* to deliver coins of the 1 cent, 10 cents and 25 cents denominations in a required number.

Where an output signal from the first digit position of the output buffer register 45 has a logic level of "1", then an output date from the register 34 is subtracted by one in the −1 subtraction circuit 37. Where a coin is delivered for the second time, the contents of the register 34 indicate [01001] as shown in FIG. 9(*c*). As mentioned above, a coin is delivered in succession in accordance with the contents of the register 34. The contents of the respective digit positions of the register 34 are subtracted by one for each delivery of a coin. Where all the contents of the respective digit positions of the register 34 indicate a digit [0], then the delivery of a coin is brought to an end. In this case, a total amount of 98 cents, that is, 3 25¢-coins, 2 10¢-coins, and 3 1¢-coins are delivered. With the foregoing embodiment, coins of four denominations, namely, the 25¢-unit, 10¢-unit, 5¢-unit and 1¢-unit were described. However, the coin-delivering device of this invention is applicable to three or fewer denominations thereof. According to the occasion, the invention may be used for delivery of coins of two denominations, for example, the 50¢-unit and 1 dol-unit.

There will now be described by reference to FIGS. 10 to 12 a coin-delivering device according to another embodiment of this invention. Parts of FIGS. 10 to 12 the same as those of FIGS. 2 and 3 are respectively denoted by the same numeral, description thereof being omitted.

As in the preceding embodiment, those portions of the lower support board 12 which face the coin outlets of the coin holders 15*a* to 15*e* are made to project into the cut-out space 16 provided in said lower support board 12 to constitute coin receptacles 17*a* to 17*e*. Coin discharge guide sections 48*a* to 48*e* are provided in those portions of the cut-out space 16 which lie between the respective coin receptacles 17*a* to 17*e*. The coin discharge guide section projects straight outward from the larger diameter peripheral line of the coin receptacle which takes a somewhat oblong shape, thereby facilitating the delivery of a coin when flipped out by a counter clockwise rotating arm 21. A coin discharge guide board 49 whose central portion is cut-out in the same form as the lower support board 12 is laminated thereon. The wall defined by said guide board 49 on said lower support board 12 along the aforesaid larger diameter peripheral line of the oblong coin receptacle guides the movement of a coin on said receptacle when flipped out by the arm 21, thereby preventing the coin from being thrown outside of the coin-delivering device. As seen from FIG. 11, a plurality of vertically extending keyways 18 are formed in the lower peripheral wall of the rotary shaft 14. The inner wall of an arm holder 51 engageable with the rotary shaft 14 is provided with a plurality of vertically extending keys 50 for engagement with said keyways. Therefore, the arm holder 51 can vertically slide along the outer wall of the rotary shaft 14 and be rotated jointly therewith. A vertically extending spring cavity 52 is bored in the lower and portion of the rotary shaft 14. The bottom end of a return compression coil spring 53 inserted into the spring cavity 52 is pressed against the inner bottom plane of the arm holder 51 to urge it downward. A horizontally extending coin-flipping arm 54 is mounted on the upper end of the arm holder 51. The coin-flipping arm 54 extends up to a gap between the coin holders 15*a* to 15*e* and coin receptacles 17*a* to 17*e*, and has such a thickness as to enter said gap. The forward and 54*a* of the coin flipping-arm 54 which touches a coin is designed to shift the coin toward the coin outlet ports $12_1$ to $12_5$ of the lower support board 12. One lateral edge of the coin-flipping arm 54 is so curred as to push a coin outside of the bottom of the coin holders 15*a* to 15*e*. The arm holder 51 and coin-flipping arm 54 are jointly rotated. The arm holder 51 is so designed as to cause the coil-flipping arm 54 to be normally set below the lower support board 12, and also to pass through a gap between the bottom of the coin holders 15*a* to 12*e* and the coin receptacles 17*a* to 17*e*, when the coil-flipping arm 54 is lifted by the energized solenoid 55. The solenoid 55 acting as driving means is provided right below the rotary shaft 14. An upward projecting plunger 56 is set at the center of the solenoid 55. The upper and of the plunger 56 is pressed against the underside of the arm holder 51. The solenoid 55 is so positioned as to cause the plunger 56 to be aligned with the rotary shaft 14. When the solenoid 55 is not energized, the plunger 56 is pressed downward by the arm holder 51 which is urged downward by the return coil spring 53. When the solenoid 55 is energized, the plunger 56 is magnetically drawn into the solenoid 55 to be moved upward against the urging force of the return coil spring 53, causing the arm holder 51 to be lifted. As the result, the coin-flipping arm 54 is moved on to the coin receptacles 17*a* to 17*e*. At this time, the coil-flipping arm 54 rises through the cut-out space provided between the respective adjacent coin receptacles 17*a* to 17*e*. The lower end of the plunger 56 is provided with a stopper 57. When the plunger 56 goes upward, the stopper 57 touches the case 58 of the solenoid 55 to prevent the excessive lift of the plunger 56. There will now be described by reference to FIGS. 10 to 12 the operation of a coin-delivering device according to a second embodiment of this invention. The rotary shaft 14 is always rotated by the motor 13. When a coin is not delivered, the arm holder 51 and coin-flipping arm 54 are rotated under the lower support board 12 jointly with the rotary shaft 14. Where a coin is to be delivered, then the solenoid 55 is energized when the coin-flipping arm 54 reaches that of the spaces provided between the respective adjacent receptacles 17*a* to 17*e* which lies just in front of the specified one of the coin holders 15*a* to 15*e* from which a coin is to be drawnout. At this time, the plunger 56 pushes the arm holder 51 to cause the coin-flipping arm 54 to be moved above the lower support board 12. The coin-flipping arm 54 which is still kept rotating passes through a gap between the specified one of the coin holders 15*a* to 15*e* and the corresponding one of the coin receptacles 17*a* to 17*e* to flip out a coin 59 (FIG. 12) which is let to fall from the specified coin holder on to the corresponding receptacle. The coin 59 is guided along the wall jointly defined by the lower support board 12 and guide board 49 toward the corresponding one of the coin discharge guide sections 48*a* to 48*e* to be taken out of the coin-delivering device. The coin 59 thus taken out falls down a coin-guiding chute 60 (FIG. 11). When coin-flipping arm 54 has passed over the specified one of the coin receptacles 17*a* to 17*e*, then the solenoid 55 is deenergized to let fall the arm holder 51. As the result, the coin-flipping arm 54 is returned to its original position below the lower support board 12 after passing through a space adjacent to the specified one of the coin receptacles 17*a* to 17*e*. As mentioned above, the coin-flipping arm 54 is operated when a drive signal is issued for the prescribed one of the coin holders 15*a* to 15*e*, thereby delivering change coins of the desired denominations in a required number. With the coin-delivering device according to the second embodiment, the plunger 56 smoothly and stably moves the arm holder 51 in a vertical direction. Further, the coin-flipping arm 54 is reliably set in a space lying between the respective adjacent coin receptacles 17*a* to 17*e*. The arm holder 51 is elastically moved under a stable condition by means of the return coil spring 53. Since the plunger 56 is aligned with the rotary shaft 12, the force of the plunger 56 is directly applied to the arm holder 51 to move it quickly and reliably. A coin 59 pushed out of the coin receptacles 17*a* to 17*e* by the coin-flipping arm 54 is moved toward the coin discharge guide sections 48*a* to 48*e* arranged outside of a circumference defined by the crosswise centers of the coin holders 15*a* to 15*e*. Therefore, a flipped coin is prevented from throwing off a coin placed on another coin receptacle or obstructing the rotation of the coin-flipping arm 54.

The lower support board 12 and guide board 49 may be integrally formed. It is also possible to provide a case instead of the guide board 49, thereby preventing a coin from being thrown in any direction than toward the coin discharge guide sections 48*a* to 48*e*. The edge of the coin-flipping arm 54 need not be arcuate, but well serves the purpose, provided the edge is so shaped as to allow a coin to be pushed in the rotating direction of said arm 54. Further, a coin handled by the coin-delivering device of this invention may have any other shape than circular. The means for setting the coin-flipping arm 54 vertically movable along the rotary shaft 14 may be constituted by any other process than the spline mechanism. The coin-delivering device of the invention is widely applicable, for example, to a cash register.

Figure 2:
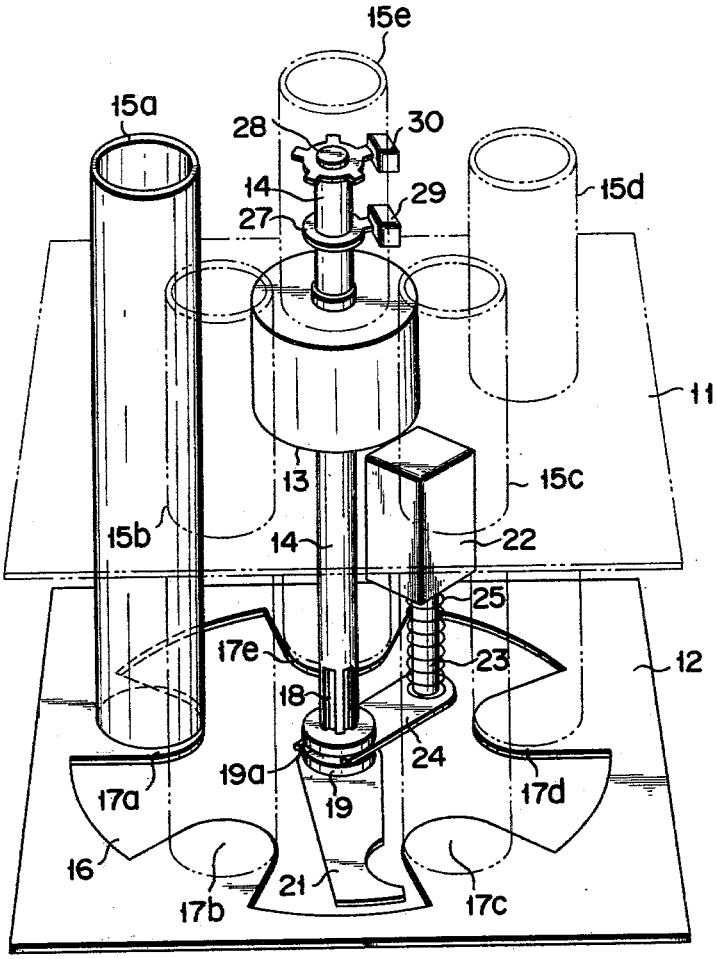
FIG. 2 is an oblique view of a change coin-delivering device used with the cash register of FIG. 1.
Figure 3:
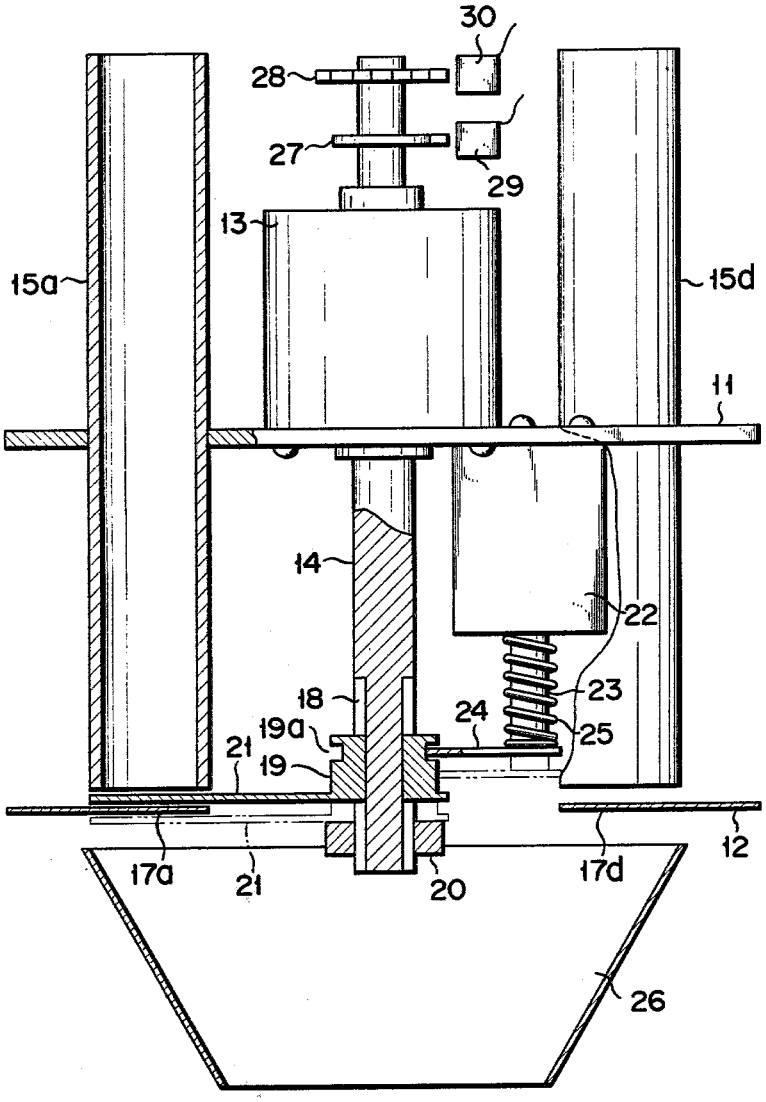
FIG. 3 is a sectional view of said change coin-delivering device.
Figure 4:
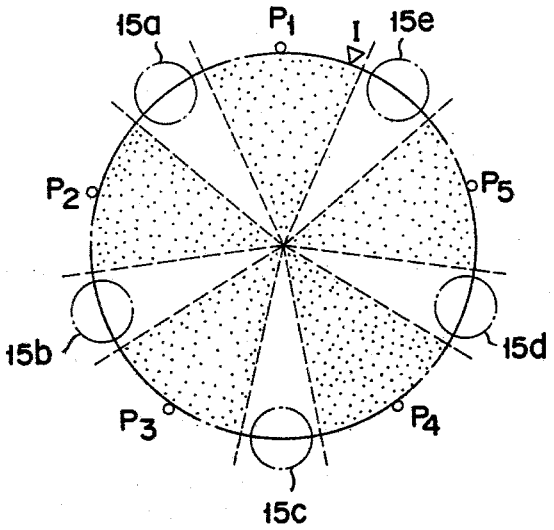
FIG. 4 illustrates the relative positions of the plural coin holders of the change coin-delivering device and the regions in which timing pulses are issued.
Figure 10:
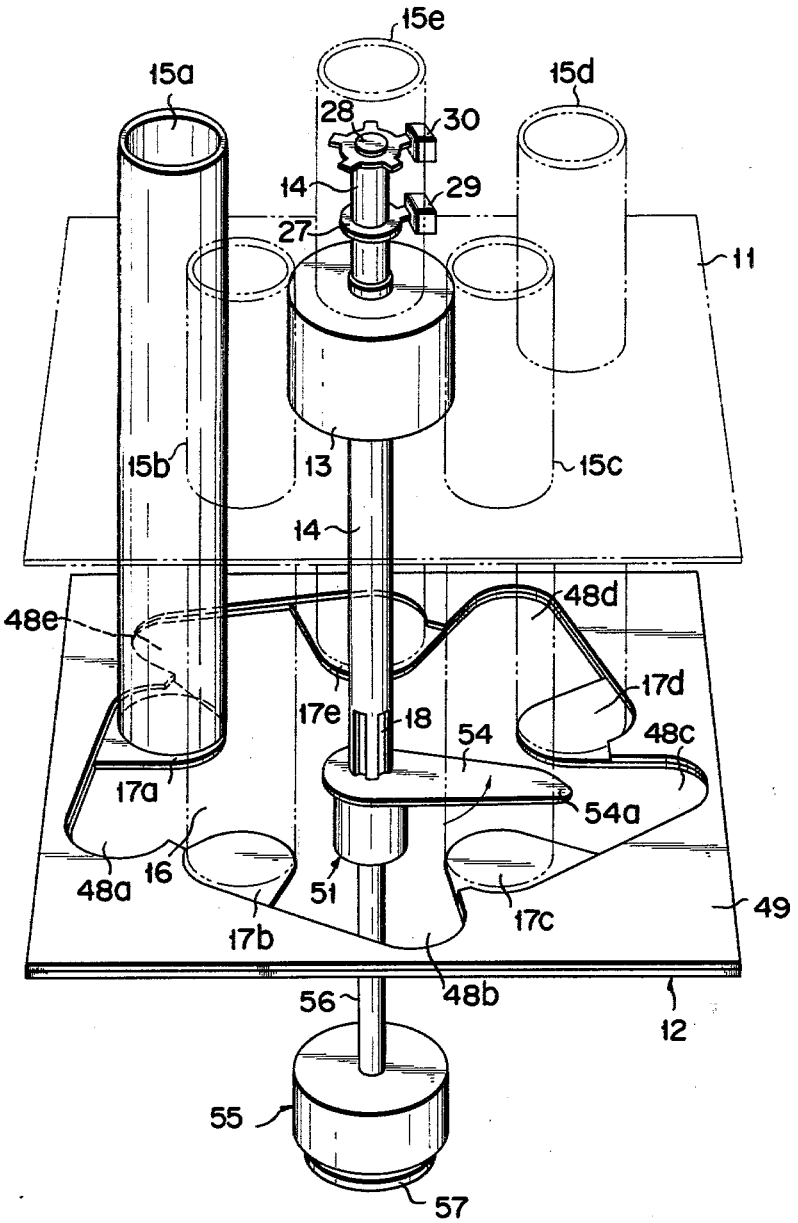
FIG. 10 is an oblique view of a coin-delivering device according to another embodiment of this invention.
Figure 11:
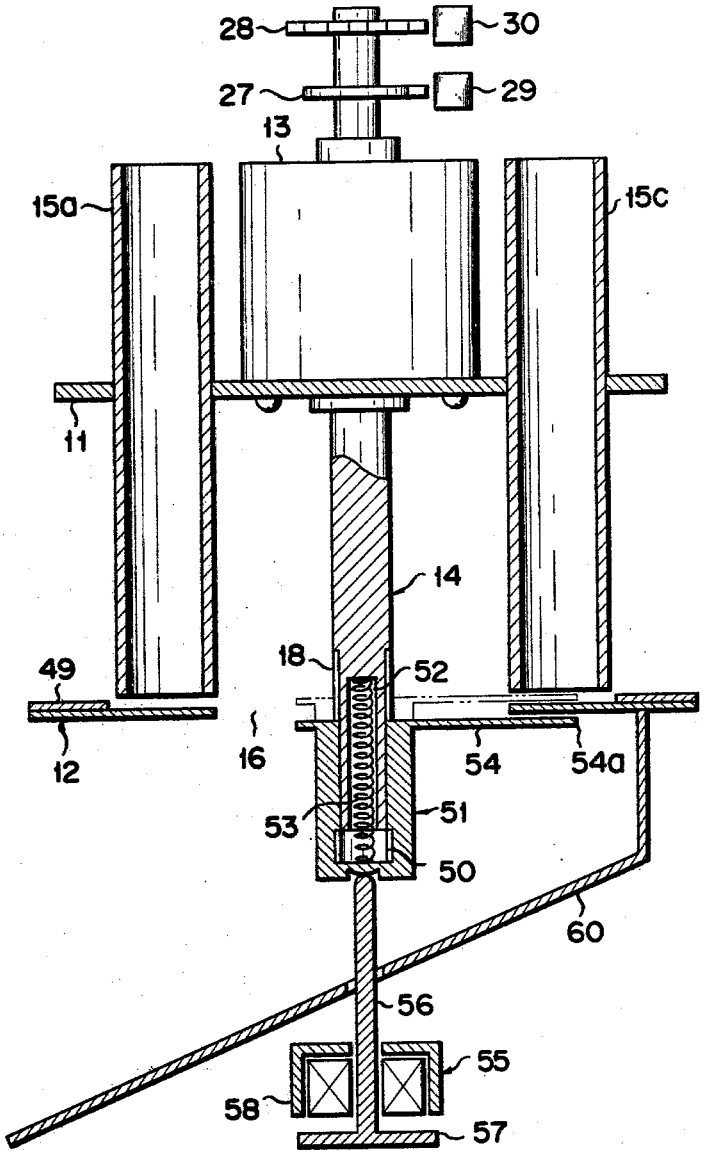
FIG. 11 is a sectional view of the coin-delivering device of FIG. 10.
Figure 12:
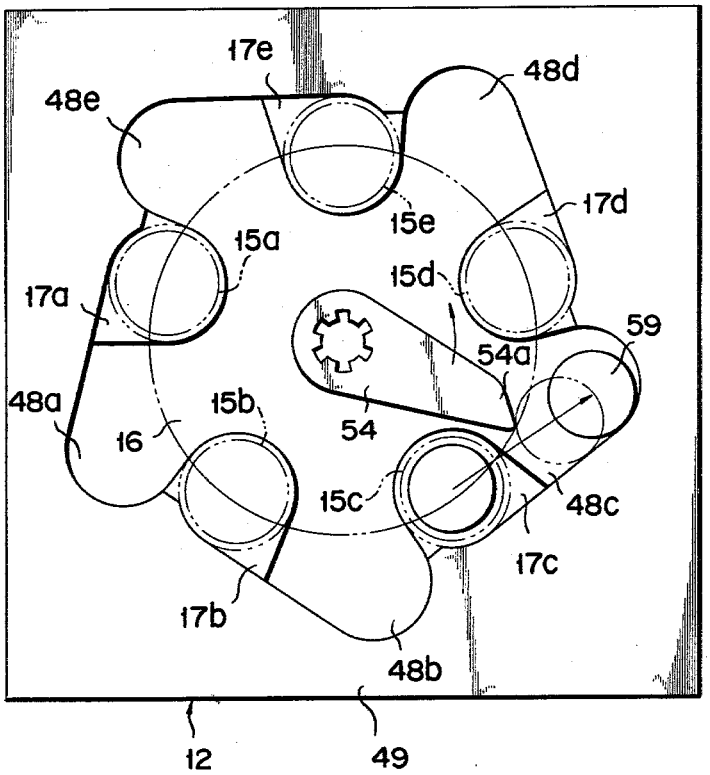
FIG. 12 is a partial view of the coin-delivering device of FIG. 10 for illustration of its operation.

The foregoing embodiments shown in FIGS. 2 and 3 as well as in FIGS. 10 to 12 comprise five coin holders 15*a* to 15*e* in conformity to the different denominations of coins being handled. However, the coin holders may be provided in any larger number than five.

What is claimed is:

1. A coin-delivering device which comprises a plurality of coin holders having coin outlets arranged at intervals in a circumferential direction; a plurality of coin receptacles set at substantially corresponding intervals in a circumferential direction below the coin outlets of the coin holders at a prescribed spacing from the coin holders to receive individual coins from the holders; a coin-flipping arm fitted to a rotary shaft, said coin flipping arm being vertically movable relative to said rotary shaft and rotatable therewith to deliver a said individual coin placed on any of the coin receptacles by the rotation of said rotary shaft; and control means for controlling the vertical movement of the coin-flipping arm along the rotary shaft, said control means being selectively operated in accordance with the rotational angle of the coin-flipping arm relative to the coin outlets of the respective coin holders in order to selectively deliver one or more coins in a predetermined manner.

2. A coin-delivering device which comprises a plurality of coin holders having coin outlets arranged at intervals in a circumferential direction; a plurality of coin receptacles set at substantially corresponding intervals in a circumferential direction below the coin outlets of the coin holders at a prescribed spacing from the coin holders to receive individual coins from the holders; a plurality of coin discharge guide sections provided between the respective adjacent coin holders on the outside of a circumference defined by the crosswise centers of said coin holders; a coin-flipping arm fitted to a rotary shaft, said coin-flipping arm being vertically movable relative to said rotary shaft and rotatable therewith to deliver a said individual coin placed on any of the coin receptacles by the rotation of said rotary shaft; and control means for controlling the vertical movement of the coin-flipping arm along the rotary shaft in order to selectively deliver one or more coins in a predetermined manner.

3. A coin-delivering device which comprises a plurality of coin holders having coin outlets arranged at intervals in a circumferential direction; a plurality of coin receptacles set at substantially corresponding intervals in a circumferential direction below the coin outlets of the coin holders at a prescribed spacing from the coin holders to receive individual coins from the holders; a plurality of coin discharge guide sections provided between the respective adjacent coin holders on the outside of a circumference defined by the crosswise centers of said coin holders; a rotary shaft positioned at the center of said circumference; a coin flipping arm; a coin-flipping arm holder holding said coin flipping arm, said arm holder being fitted to one end of the rotary shaft so as to be vertically movable relative to said rotary shaft and rotatable with said rotary shaft, said arm holder holding the coin-flipping arm for selectively pushing a said individual coin placed on the coin receptacle toward the coin discharge guide section and also selectively vertically sliding along the peripheral surface of the rotary shaft.

4. The coin-delivering device according to claim 3, wherein said rotary shaft has a cavity in the lower portion thereof; and comprising a spring inserted into said cavity of the rotary shaft with the bottom of said spring pressed against the inner bottom wall of the coin-flipping arm holder, thereby effecting an elastic vertical movement of said arm holder.

5. The coin-delivering device according to claim 3, comprising means for raising and lowering said arm holder; and means for pressing said arm holder toward a lowered position on said rotary shaft, said pressing means being aligned with the rotary shaft.

6. The coin-delivering device according to any one of claims 1, 2 or 3, wherein the coin-flipping arm is rotatable around the center of the circumference of the coin receptacles and is vertically movable along the rotary shaft to be set above or below said coin receptacles.

7. The coin-delivering device according to any one of claims 1, 2 or 3, wherein said coin holders are equiangularly arranged in said circumferential direction, and said coin receptacles are set similarly equiangularly in said circumferential direction below said coin outlets of said coin holders.

8. The coin-delivering device according to either of claims 1 or 2, wherein said control means comprises a solenoid coupled to said coin-flipping arm for vertically moving said coin-flipping arm along said rotary shaft.

9. The coin-delivering device according to claim 8 wherein said solenoid comprises spring means for biasing said coin-flipping arm in a lower direction, said solenoid when actuated raising said coin-flipping arm along said rotary shaft in a vertical direction against said spring means.

* * * * *